US005336534A

United States Patent [19]

Nakajima et al.

[11] Patent Number: 5,336,534

[45] Date of Patent: Aug. 9, 1994

[54] COATING METHOD EMPLOYING ULTRASONIC WAVES

[75] Inventors: Kenji Nakajima; Kimiaki Miyamoto, both of Kanagawa, Japan

[73] Assignee: Fuji Photo Film Co., Ltd., Kanagawa, Japan

[21] Appl. No.: 48,257

[22] Filed: Apr. 16, 1993

[30] Foreign Application Priority Data

Apr. 21, 1992 [JP] Japan ..... 4-126657

[51] Int. Cl.[5] ..... B05D 3/12

[52] U.S. Cl. ..... 427/600; 427/457

[58] Field of Search ..... 427/600, 457

[56] References Cited

U.S. PATENT DOCUMENTS

| | | | |
|---|---|---|---|
| 3,645,735 | 2/1972 | Danielson et al. . | |
| 4,463,040 | 7/1984 | Kisler | 427/600 |
| 4,826,703 | 5/1989 | Kisler | 427/469 |
| 5,049,404 | 9/1991 | Kisler et al. | 427/600 |
| 5,190,789 | 3/1993 | Finnicum | 427/10 |

FOREIGN PATENT DOCUMENTS

| | | |
|---|---|---|
| 1646052 | 7/1970 | Fed. Rep. of Germany . |
| 2050682 | 4/1971 | Fed. Rep. of Germany . |
| 2012800 | 3/1970 | France . |
| 59-042036 | 3/1984 | Japan . |

*Primary Examiner*—Shrive Beck
*Assistant Examiner*—David M. Maidrana
*Attorney, Agent, or Firm*—Sughrue, Mion, Zinn, Macpeak & Seas

[57] ABSTRACT

A coating method by which the speed of coating can be improved remarkably regardless of the number of polar groups on the surface of a web and irrespective of the properties of material for the web. A coating solution flowing out of a liquid injector is applied to a web supported by a coating backup roller. A high frequency signal from a master oscillator is amplified and applied to a vibrator. Ultrasonic waves generated in the vibrator are guided by a horn to be radiated to the contact line between the coating solution and the web. With the invention it is possible to prevent a coating solution from being intermittently applied to a web, and it is also possible to increase the coating limit speed, for example, by 5 to 26%. In addition, lateral stair-stepped unevenness of thickness is not produced in the coating layer.

6 Claims, 1 Drawing Sheet

COATING METHOD EMPLOYING ULTRASONIC WAVES

BACKGROUND OF THE INVENTION

The present invention relates to a method for applying various solutions onto a continuously running belt-like flexible support web, particularly in the production of photographic sensitive materials such as photographic film, printing paper, or the like.

The following methods have been proposed for increasing the coating speed of a web.

(1) A method in which a high voltage is applied to a coating backup roller so as to prevent a liquid break between a liquid injector and the web (see British Patent No. 1,166,500).

(2) A coating method in which a high DC voltage is applied to a discharge electrode so as to produce a corona discharge to thereby apply unipolar charge to a surface of a web (see U.S. Pat. No. 4,835,004).

(3) A method for coating a web at a higher temperature than room temperature by heating the web before coating (see U.S. Pat. No. 4,835,004).

(4) A coating method in which a high DC voltage is applied to a coating backup roller in the case of coating a wed having a gelatinous undercoat layer containing a surface-active agent (see U.S. Pat. No. 4,837,045).

In the case where a high DC voltage is applied to a coating backup roller as in method (1), or in the case where a high DC voltage is applied to a discharge electrode to produce corona discharge thereby to apply unipolar charges on a surface of a web as in method (2), if the number of polar groups on the surface of the web is relatively large, that is, if a surface-active agent is employed as in method (4), the wetting property of the surface of the web is generally improved to make it possible to increase the speed of coating because of the orientation of the polar groups relative to the surface of the web as well as the electrostatic attraction caused by the applied electric field. However, if the number of polar groups on the surface of the web is relatively small (e.g., not more than $4\times10^{-3}$ eq/m$^2$ polar groups per web unit area from the surface of the web to a depth of 1 $\mu$m), the wetting property of the surface of the web is not improved due to the above-mentioned orientation of polar groups. Thus, there is a problem in that the speed of coating cannot be increased as much as desired.

Further, method (3) has a problem in that the method cannot be applied to the case where a material, such as polyolefin, having a low melting point and a low glass transition point is used as a material for the web.

SUMMARY OF THE INVENTION

It is therefore an object of the present invention to solve the above-mentioned problems and to provide a coating method by which the speed of coating can be improved remarkably regardless of the number o#polar groups on the surface of the web and irrespective of the properties of the material of the web.

The foregoing and other objects of the present invention have been attained by a coating method for coating a continuously running belt-like flexible support with a coating solution, characterized by radiating ultrasonic waves on or near a contact line between the web and the coating solution.

According to the present invention, by applying ultrasonic waves to the contact line between the web and the coating solution or in the vicinity of the contact line, a thin air layer entrained with the web before the web is coated with the coating solution is vibrated, so that the air layer is divided into smaller bubbles and dissolved into the coating solution more rapidly. Therefore, a problem called air entrainment phenomenon caused by the air layer being entrapped between the web and the coating solution can be prevented, making it possible to increase the speed of coating. (With respect to a theoretical description of the air entrainment phenomenon, see Miyamoto and Scriven, Paper p1018, AlChE Annual Meeting (1982)).

Preferably the frequency of the ultrasonic waves is from 10 to 120 KHz, and the amplitude of the acoustic pressure (peak-to-peak) is not less than 15 mmAq. Preferably the ultrasonic waves are applied so that the air layer accompanying the web is vibrated immediately before contact of the web with the coating solution. Accordingly, the application point is set on the contact line between the web and the coating solution, or within 5 cm therefrom.

For generating the ultrasonic waves, an electrical device of the piezoelectric type, electric distortion type or magnetic distortion type, or a mechanical device can be used. Preferably, a magnetic distortion type of device having a wide frequency range is utilized because of the available bandwidth and the media employed for propagating the ultrasonic waves.

Ultrasonic wave oscillators can be classified into a self-excited oscillation type and a master-oscillator power amplification type. If a frequency adjustment is required, preferably the master-oscillator power amplification type oscillator capable of amplifying a master-oscillator signal electrically is used. Accordingly, in a case where some degree of freedom for selecting conditions is necessary, a combination of a magnetic distortion type generator and a master-oscillator power amplifier is advantageous. In view of the above, the ultrasonic waves are preferably generated by means of a master oscillator, an amplifier and a vibrator as an ultrasonic wave generating source, or constituted by these elements and a horn attached to the vibrator if necessary. For radiating the ultrasonic waves, the vibrator or the horn may be placed in contact with the web, or the vibrator or the horn may be placed adjacent the web across a sufficiently small gap that the ultrasonic waves are not; significantly attenuated.

As the web used in the practice of the present invention, a paper web, a plastic film web, a resin-coated paper web, a synthetic paper web or the like may be used. Examples of the material for the plastic film web include polyolefins such as polyethylene, polypropylene, etc.; vinyl copolymers such as polyvinyl acetate, polyvinyl chloride, polystyrene, etc.; polyamides such as 6,6-Nylon, 6-Nylon, etc.; polyesters such as polyethylene terephthalate, polythylene-2,6-naphthalate, etc.; polycarbonates; cellulose acetates such as cellulose triacetate cellulose diacetate, etc. If necessary, an undercoating layer such as gelatin may be applied to the surface of the web. Although polyolefins such as polyethylene and the like are typical examples of resins used for the resin-coated paper web, the resin is not limited to these specific examples. The surface of the resin-coated paper web not only may be a smooth surface, but also may be a rough surface having mean roughness of not more than 5 $\mu$m.

Examples of the coating solution used in the present invention include various compositions to be selected according to the purposes in use thereof. Specific examples thereof include coating solutions such as a sensitive emulsion layer, an undercoating layer, a protective layer, a backing layer or the like, in the field of photographic sensitive materials, and other coating solutions such as an adhesive layer, a coloring dye layer, an oxidation-preventing layer or the like. These coating solutions can include water soluble binders or organic binders.

For applying the above-mentioned coating solutions onto the web, there are available techniques such as slide coating, roller bead coating, extrusion coating, curtain coating, and the like, that is, a method which forms the coating solution as a film or beads in a continuous manner. Such techniques may be used together with a method in which the vicinity of the contact line between the coating solution and the web is filled with a highly soluble gas such as carbon dioxide (see U.S. Pat. No. 4,842,900 and Japanese Patent Unexamined Publication No. Sho-62-197176). Further, other methods may be used in combination.

BRIEF DESCRIPTION OF THE DRAWING

The single drawing figure is a schematic side view of an apparatus for realizing the coating method of a preferred embodiment of the present invention.

DESCRIPTIONS OF THE PREFERRED EMBODIMENTS

Figure 1:
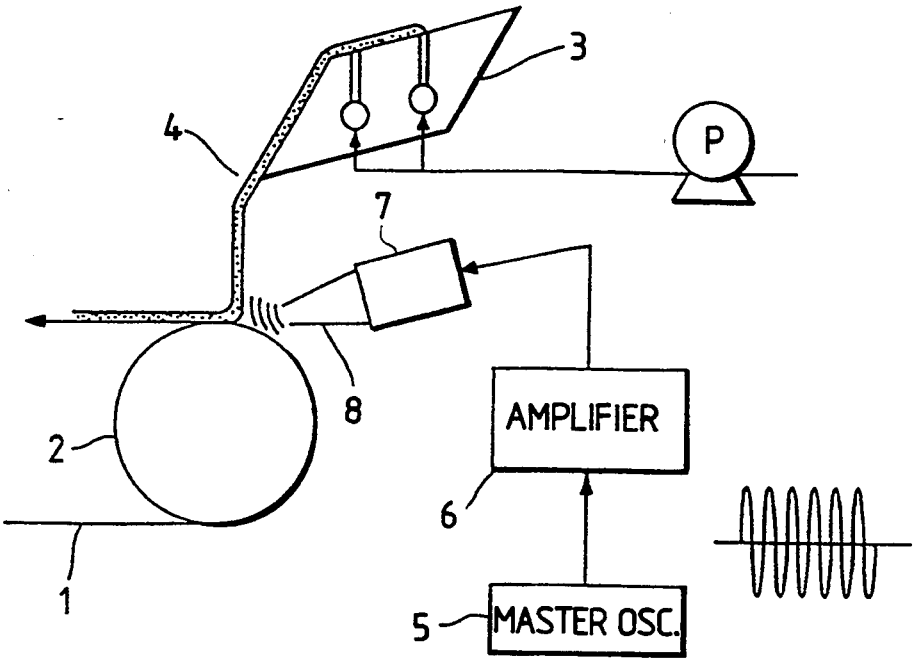

Preferred embodiments of the present invention will be described with reference to the drawing.

In the single drawing figure, a coating solution 4 flowing out of a liquid injector 3 is applied to a web 1 supported by a coating backup roller 2. A high frequency signal from a master oscillator 5 is amplified by an amplifier 6, and the resulting amplified signal is applied to a vibrator 7. An ultrasonic wave generated by the vibrator 7 is guided by a horn 8 thereby to be applied to the contact line between the coating solution 4 and the web 1.

The present invention will be described in more detail on the basis of the following examples. However, the present invention is not to be limited to the examples.

One web (A) employed in this example was a resin-coated paper of polyethylene with a thickness of 220 μm, in which the surface to be coated was primarily coated with a 0.3 μm thick gelatin layer, and the back surface was primarily coated with an alumina sol layer. The mean surface roughness Ra of the coated surface was 1.4 μm.

Another web (B) was made of cellulose triacetate of a thickness of 122 μm in which the surface to be coated was primarily coated with a 0.3 μm thick gelatin layer, and the back surface was primarily coated with an electrically conductive macromolecule. The mean surface roughness Ra of the coated surface was 0.1 μm.

As coating solution, a coating solution (a) was prepared by adding 0.75 g/l of sodium dodecyl-benzene-sulfonate as a surface-active agent and a red dye to a solution (12.5 wt %) of lime-treated gelatin (made by Nitta Gelatin, Inc.). Another coating solution (b) was prepared by adding lime-treated gelatin to a solution containing silver particles used as a halation prevention layer for a color negative film to adjust the weight proportion of gelatin to 12.5% by weight and further by adding the same surface-active agent and dye as in the coating solution (a) in the same proportions. Sodium polystyrene-sulfonate was added to each of the coating solutions (a) and (b) to adjust the viscosity to 70 cp at a shearing rate of 50 $sec^{-1}$.

A curtain-type coating method was employed in which a coating solution was ejected from a manifold in the liquid injector and poured downward on the inclined surface of the liquid injector through slots and then allowed to freely drop onto the web. The distance through which the coating solution freely dropped was 10 cm. The flow rate of the coating solution from the liquid injector was 1.25 ml/sec per 10 mm width of the liquid injector.

To apply ultrasonic waves, a function generator SG4111 made by Iwatsu Electric Co., Ltd., was used as a master oscillator. The output of the master oscillator was amplified by a power amplifier "Mimesis-8" made by Goldmund Co, Ltd. (Switzerland). A ribbon-type tweeter PT-R7III made by Pioneer Electronic Corp. was used as a vibrator. A brass horn with a thickness of 1 mm, length of 40 mm, and ratio of vibrating surface area to top end opening area of 10:1 was employed as a horn.

The waveforms of input signals from the master oscillator to the amplifier were sine waveforms. The frequency range was from 10 to 120 KHz, and the amplitude range was from 0 to 300 mV peak-to-peak. The distance from the horn top end to the contact line between the web and the freely dropping film of the coating solution was 20 mm. When the amplitude of the signal generated by the master oscillator was 300 mV, the peak-to-peak amplitude of the ultrasonic waves at the point of application to the web was 33 mmAq.

While changing the frequency and amplitude of the applied ultrasonic waves, the running speed of the web at which the air entrainment phenomenon disturbing the coating of the coating solution began to occur was measured.

As comparative examples, the same coating solutions, the same supports and the same coating methods as in the above examples of the invention were used, but ultrasonic waves were not applied. Similarly, the running speed of the web at which the air entrainment phenomenon disturbing the coating of the coating solution began to occur was measured.

The comparative examples were compared with the examples of the present invention. Tables 1 to 4 show the measurement results for four combinations of two kinds of webs and two kinds of coating solutions- Also, when applying the ultrasonic waves, lateral stair-stepped unevenness of thickness was not produced in the coating layer.

Table 1 shows the coating limit speed (m/min) for a combination of the web (B) and the coating solution (a).

TABLE 1

| Comparative Example | No ultrasonic waves applied | | | Coating Limit Speed (m/min) 254 | | | | | |
|---|---|---|---|---|---|---|---|---|---|
| Inventive | Ultrasonic waves | Frequency (KHz) | | 10 | 20 | 40 | 60 | 100 | 120 |
| Examples | appplied | Amplitude | 16 | 261 | 266 | 274 | 263 | 258 | 256 |

TABLE 1-continued

| Comparative Example | No ultrasonic waves applied | | Coating Limit Speed (m/min) 254 | | | | | |
|---|---|---|---|---|---|---|---|---|
| | (mmAq) | 35 | — | 271 | 302 | 292 | 293 | 266 |

Table 2 shows coating limit speed (m/min) for another combination of the web (B) and the coating solution (b).

TABLE 2

| Comparative Example | No ultrasonic waves applied | | Coating Limit Speed (m/min) 291 | | | | | |
|---|---|---|---|---|---|---|---|---|
| Inventive Examples | Ultrasonic waves applied | Frequency (KHz) | 10 | 20 | 40 | 60 | 100 | 120 |
| | | Amplitude: 35 mmAq | 318 | 331 | 338 | 319 | 335 | 320 |

Table 3 shows coating limit speed (m/min) for a further combination of the web (A) and the coating solution (a).

TABLE 3

| Comparative Example | No ultrasonic waves applied | | Coating Limit Speed (m/min) 278 | | | | | |
|---|---|---|---|---|---|---|---|---|
| Inventive Examples | Ultrasonic waves applied | Frequency (KHz) | 10 | 20 | 40 | 60 | 100 | 120 |
| | | Amplitude: 35 mmAq | 321 | 317 | 321 | 336 | 327 | 310 |

Table 4 shows the coating limit speed (m/min) in a still further combination of the web (A) and the coating solution (b).

TABLE 4

| Comparative Example | - No ultrasonic waves applied | | Coating Limit Speed (m/min) 276 | | | | | |
|---|---|---|---|---|---|---|---|---|
| Inventive Examples | Ultrasonic waves applied | Frequency (KHz) | 10 | 20 | 40 | 60 | 100 | 120 |
| | | Amplitude: 35 mmAq | 337 | 331 | 348 | 344 | 329 | 288 |

As can be appreciated from the above, according to the coating method of the present invention, it was possible to prevent a coating solution from breaking from a web, and it was also possible to increase the coating limit speed, for example, by 5 to 25%. In addition, lateral stair-stepped unevenness of thickness was not produced in the coating layer when ultrasonic waves were applied.

What is claimed is:

1. A coating method for coating a continuously running flexible support with a coating solution by expelling said coating solution from a coating device onto said support so as to form a contact line between said coating solution and said support, wherein the improvement comprises continuously radiating ultrasonic waves from an ultrasonic wave generator separate from said coating device on or near a contact line between said support and said coating solution from a position rearward of said contact line so as to continuously vibrate an air layer accompanying said support immediately before contact of said support with said coating solution.

2. The coating method of claim 1, wherein said ultrasonic waves have a frequency in a range of 10 to 120 KHz.

3. The coating method of claim 1, wherein said ultrasonic waves have a peak-to-peak amplitude of not less than 15 mmAq.

4. The coating method of claim 2, wherein said ultrasonic waves have a peak-to-peak amplitude of not less than 15 mmAq.

5. The coating method of claim 1, wherein an application point of said ultrasonic waves is within 5 cm of said contact line.

6. The coating method of claim 1, wherein said ultrasonic waves are applied through a horn.

* * * * *